US008919416B2

(12) United States Patent
Chen

(10) Patent No.: US 8,919,416 B2
(45) Date of Patent: Dec. 30, 2014

(54) APPARATUS FOR RAISING AND LOWERING COVERING MEMBER OF WINDOW COVERING

(71) Applicant: Nien Made Enterprise Co. Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 134 days.

(21) Appl. No.: 13/833,076

(22) Filed: Mar. 15, 2013

(65) Prior Publication Data

US 2014/0262083 A1 Sep. 18, 2014

(51) Int. Cl.
*E06B 9/322* (2006.01)
*E06B 9/24* (2006.01)

(52) U.S. Cl.
CPC ..... *E06B 9/24* (2013.01)
USPC ..... 160/170; 160/178.1 R; 160/84.04

(58) Field of Classification Search
CPC ..... E06B 9/322; E06B 9/32; E06B 9/60; E06B 2009/3222
USPC ..... 160/84.04, 84.05, 168.1 R, 170, 178.1 R
See application file for complete search history.

(56) References Cited

U.S. PATENT DOCUMENTS

| | | | | |
|---|---|---|---|---|
| 4,760,622 | A * | 8/1988 | Rohrman | 16/196 |
| 5,477,904 | A * | 12/1995 | Yang | 160/370.23 |
| 7,398,815 | B2 * | 7/2008 | Liang | 160/170 |
| 7,406,995 | B2 * | 8/2008 | Huang | 160/170 |
| 7,487,817 | B2 * | 2/2009 | Liang | 160/170 |
| 7,984,745 | B2 * | 7/2011 | Wen et al. | 160/170 |
| 2006/0137831 | A1 * | 6/2006 | Lin | 160/84.04 |
| 2008/0289774 | A1 * | 11/2008 | Ying | 160/178.1 R |

* cited by examiner

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

An apparatus for raising and lowering a covering member of a window covering includes a sliding base, a first biasing device, a connecting device, and a second biasing device. The sliding base is moved between a first position and a second position in a headrail. The first biasing device has two first biasing members to urge the sliding base toward the first position. The connecting device is moved between a third position and a fourth position in the headrail. The second biasing device has a second biasing member to urge the connecting device toward the third position. The second biasing member of the second biasing device is added at a middle of raising the covering member to help the covering member totally received close to or in the headrail.

9 Claims, 10 Drawing Sheets

APPARATUS FOR RAISING AND LOWERING COVERING MEMBER OF WINDOW COVERING

BACKGROUND OF THE INVENTION

1. Field of the Invention

The present invention relates generally to a cordless window covering, and more particularly to an apparatus for raising and lowering a covering member of a window covering.

2. Description of the Related Art

In a conventional cordless window covering, it has a headrail, a bottom rail, a covering member with opposite end connected to the headrail and the bottom rail, and a driving device for raising and lowering the covering member. Typically, the driving device is received in the headrail. The conventional driving device is provided with a reel member. The reel member provides a recovering force to sustain the weight of the covering member and the bottom rail, so that when a user lowers the covering member, the bottom rail will stay at a position where the user releases the covering member. On the contrary, when a user raises the covering member, the recovering force of the reel member will wind the covering member. The conventional reel member has a spiral mainspring to provide the recovering force. The mainspring will fatigue after a long time of use, which makes the covering member unable to be totally received in the headrail.

SUMMARY OF THE INVENTION

The primary objective of the present invention is to provide an apparatus of raising and lowering a covering member of a window covering, which may totally wind the covering member in the headrail even after the window covering is used for a long time.

According to the objective of the present invention, an apparatus for raising and lowering a covering member of a window covering includes a sliding base, a first biasing device, a connecting device, and a second biasing device. The sliding base has a coupling portion, and is moved between a first position and a second position in a headrail. The first biasing device has a first string, a first reel, and at least one first biasing member. The first string has an end fastened to the sliding base and is wound around the first reel. The first biasing member is deformed by the first reel to urge the sliding base toward the first position. The connecting device has a connecting portion in association with the coupling portion of the sliding base. The connecting device is moved between a third position and a fourth position in the headrail. The third position is close to the first position, and the fourth position is between the first position and the second position. The second biasing device has a second biasing member, wherein the second biasing member urges the connecting device toward the third position. The connecting portion of the connecting device disengages the coupling portion of the sliding base when the sliding base is moved toward the second position from the first position and arrives at the fourth position, and the connecting portion of the connecting device engages the coupling portion of the sliding base when the sliding base is moved toward the first position from the second position and arrives at the fourth position.

In an embodiment, an arm located within the headrail has an end portion, and the end portion has a first stop face; the connecting device is moved in the arm between the third position and the fourth position; the connecting device has a stop face to touch the first stop face of the arm when the connecting device is moved to the fourth position.

In an embodiment, the arm has an elongated slot, which is open at a top side and a bottom side of the arm. The connecting device has a buckle and a shaft fixed to the buckle. The buckle engages the elongated slot through the shaft. The shaft is connected to the second biasing device and is rested on the top side of the arm, so that the buckle can be moved in the elongated slot between the third position and the fourth position.

In an embodiment, the coupling portion of the sliding base is a fixed rod. The buckle has a body and a head. The body is received in the elongated slot. The shaft is transversely mounted through the body and is rested on the top side of the arm. The head is under the bottom side of the arm. The connecting portion is a recess on the head to engage the fixed rod.

In an embodiment, the end portion further has a second stop face; the shaft touches the second stop face when the connecting device is moved to the fourth position; and at the same time, the buckle swings to have its stop face touching the first stop face when the sliding base moves toward the second position from the first position.

In an embodiment, the arm has a first rod and a second rod; the second rod has the end portion; and the second rod movably engages the first rod to change a location of the end portion.

In an embodiment, the first rod has a plurality of protrusions; and second rod has a bore to engage one of the protrusions of the first rod.

In an embodiment, the second biasing device has a second string and a second reel; the second string has an end fastened to the connecting device and is wound around the second reel; the second biasing member turns the second reel to wind the second string and so as to move the connecting device toward the third position.

In an embodiment, the second biasing member is a spring with opposite ends connected to the connecting device and the headrail to provide the second recovering force.

Therefore, the covering member may be totally wound in the headrail even after the window covering is used for a long time.

DETAILED DESCRIPTION OF THE INVENTION

Figure 1:
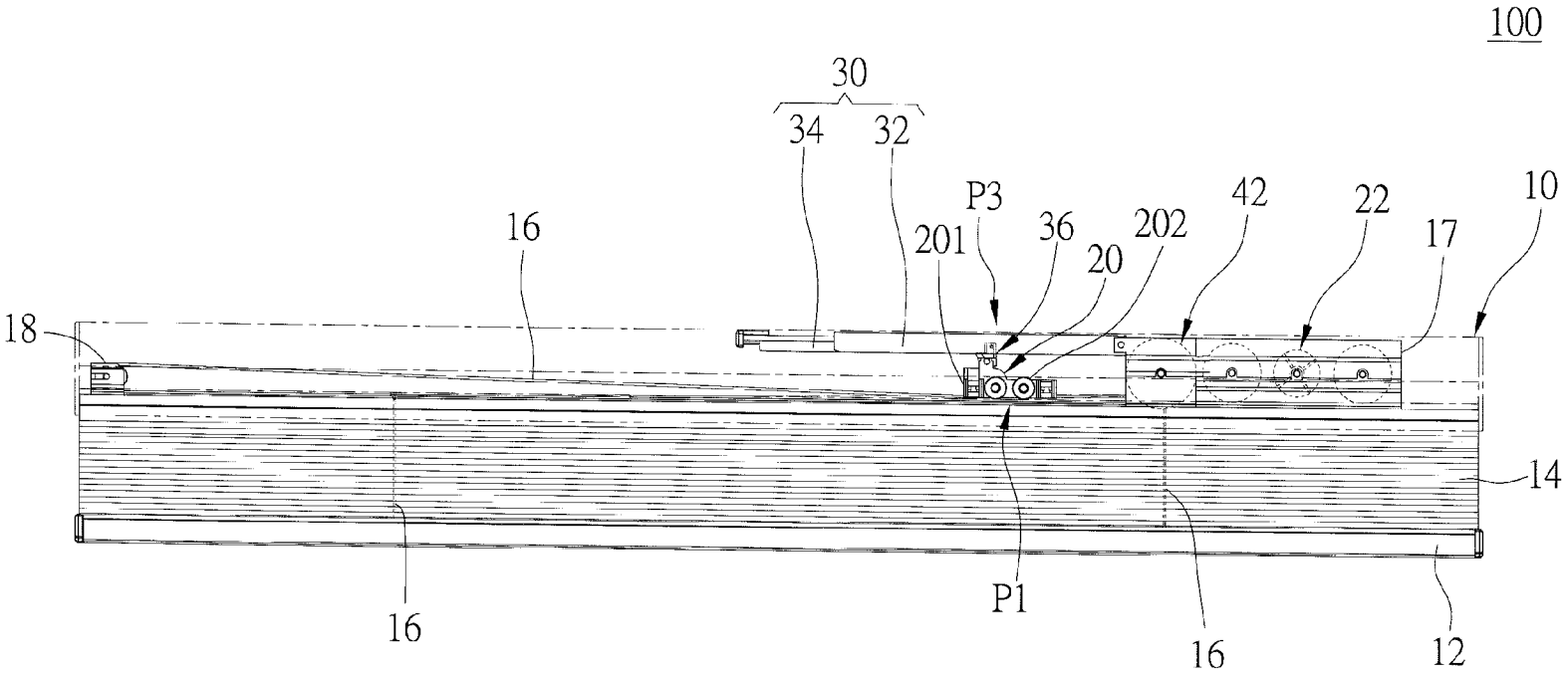
FIG. 1 is a front view of the window covering of a first preferred embodiment of the present invention.
Figure 2:
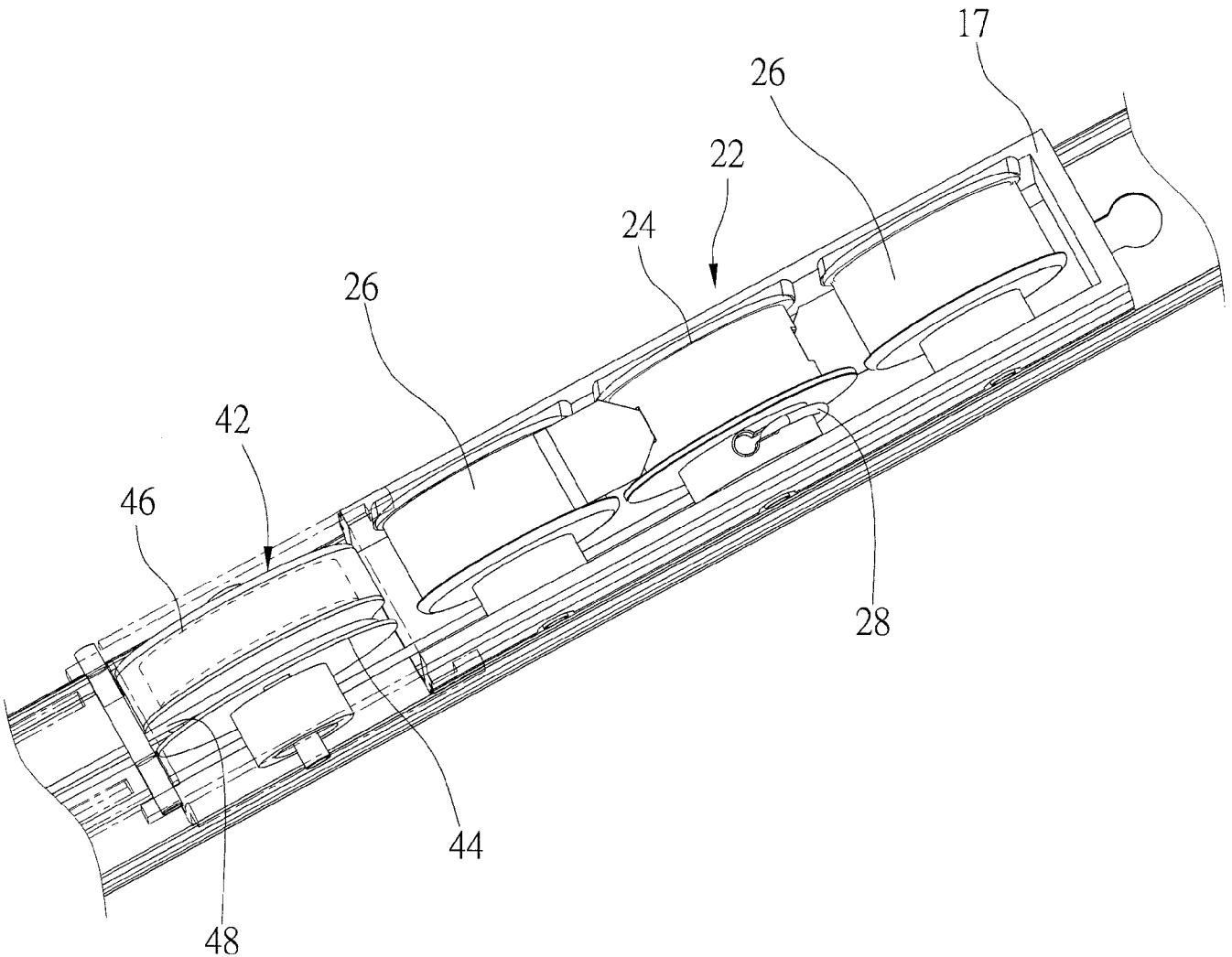
FIG. 2 is a perspective view of the first preferred embodiment of the present invention, showing the first biasing device and the second biasing device in the base.
Figure 3:
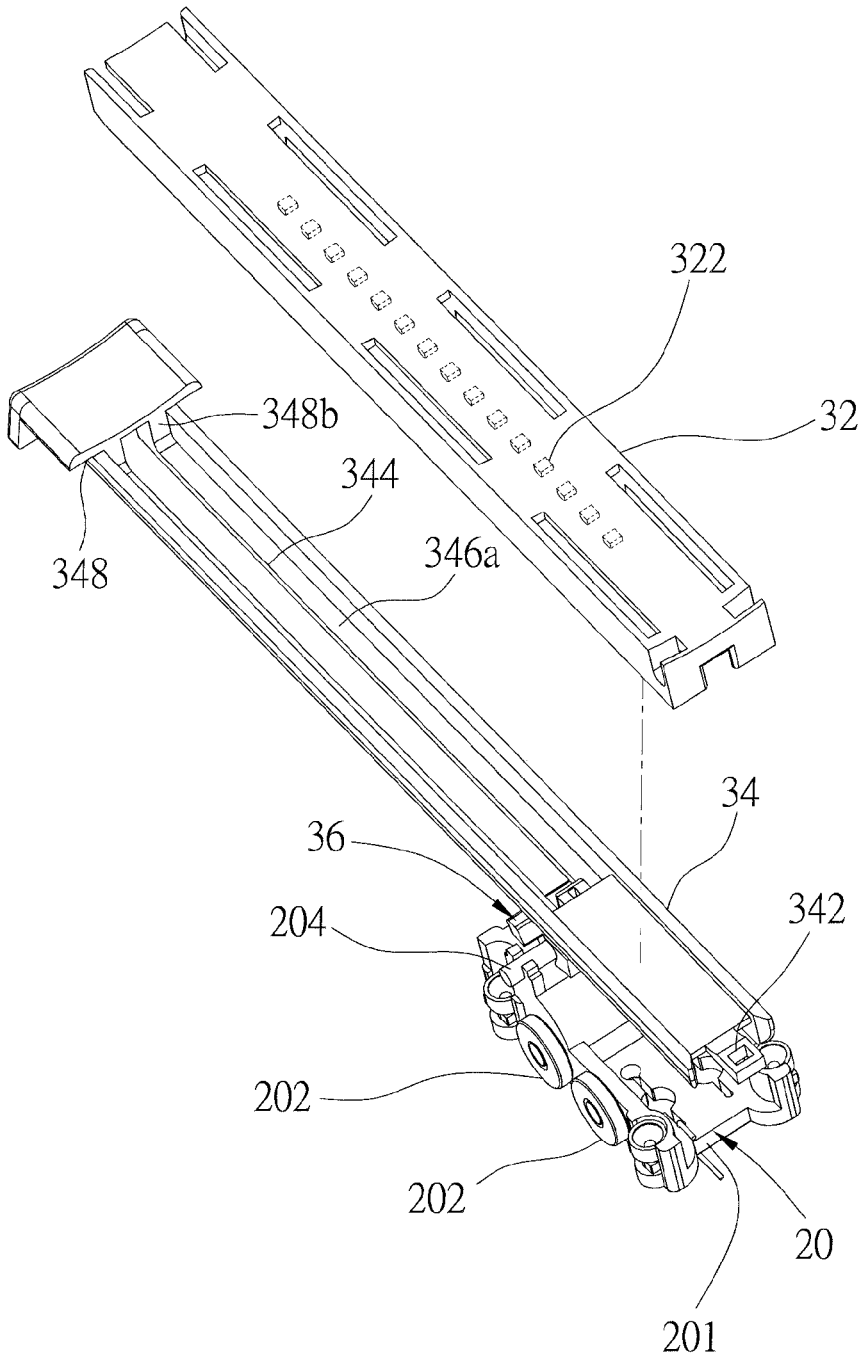
FIG. 3 is an exploded view of the first preferred embodiment of the present invention, showing the arm and the sliding base.
Figure 4:
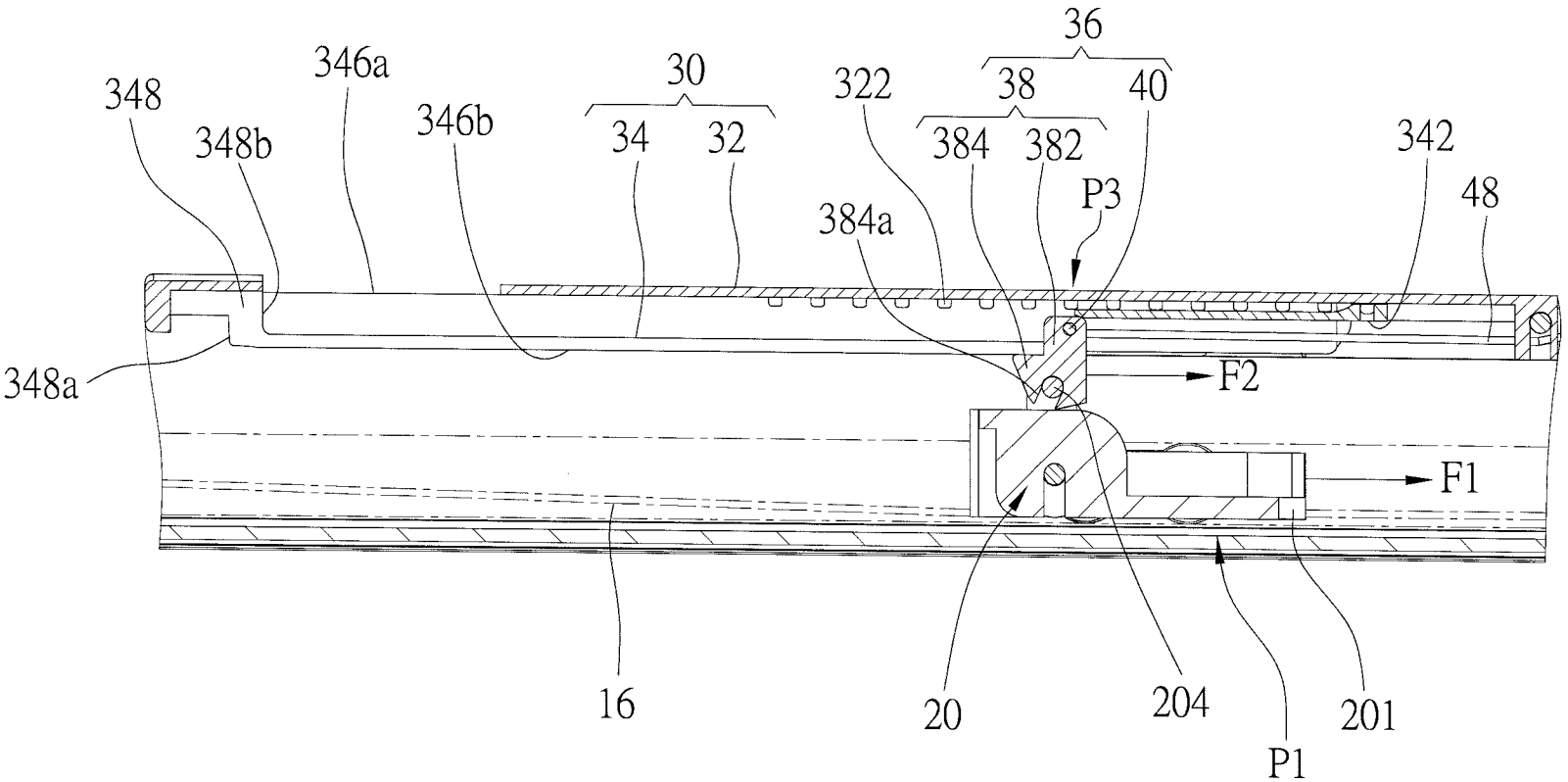
FIG. 4 is a sectional view of the first preferred embodiment of the present invention, showing the sliding base at the first position.

FIG. 1 shows a window covering 100 of the first preferred embodiment of the present invention, including a headrail 10, a bottom rail 12, a covering member 14 with opposite ends connected to the headrail 10 and the bottom rail 12, and two covering strings 16. In the headrail 10, a fixed base 17 and a pulley device 18 are provided, and they respectively are at opposite ends of the headrail 10. The covering strings 16 are wound around the pulley device 18 and pass through the covering member 14, and then are fastened to the bottom rail 14. These elements are the same as the elements in a conventional window covering, so we don't describe the detail here.

As shown in FIGS. from FIG. 2 to FIG. 8, the window covering 100 of the present invention further includes an apparatus for raising and lowering the covering member 14. The apparatus, which is received in the headrail 10, includes a sliding base 20, a first biasing device 22, an arm 30, a connecting device 36, and a second biasing device 42.

Figure 7:
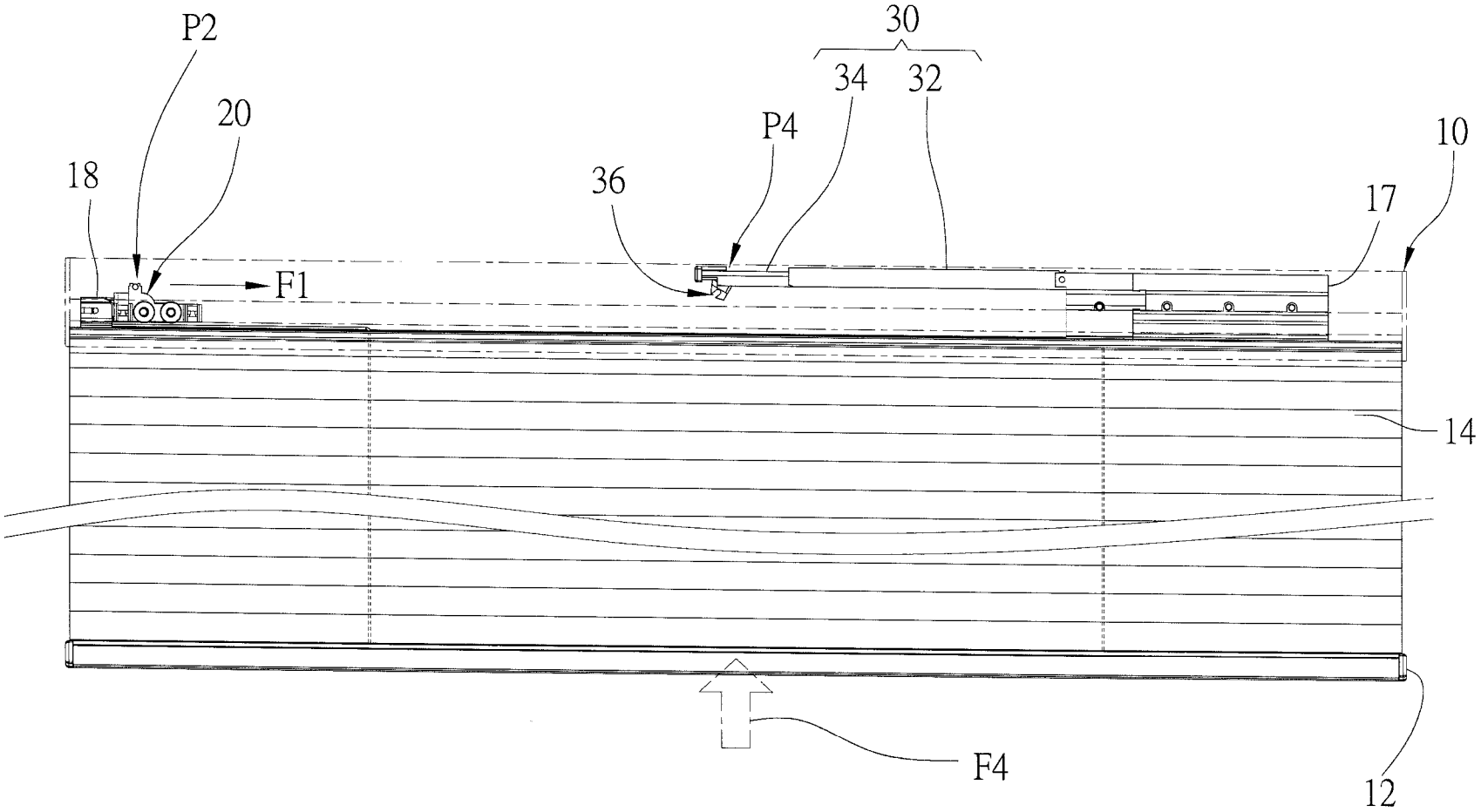
FIG. 7 is a front view of the first preferred embodiment of the present invention, showing the covering member being raised and the sliding base being moved toward the first position.

The sliding base 20, which is received in the headrail 10, has a body 201, a plurality of pulleys 202, and a coupling portion, which is a fixed rod 204 in the present embodiment. The pulleys 202 are mounted on the body 201 for rotation. The sliding base 20 is movable between a first position P1 (FIG. 1) and a second position P2 (FIG. 7). The fixed rod 204 is on a top of the body 201.

The first biasing device 22 has a first reel 24, two first biasing members, which are spiral springs 26 in the first embodiment, and a first string 28. In an embodiment, the first string 28 is a band or a cord. The first reel 24 and the spiral springs 26 are received in the fixed base 17 of the headrail 10. The first string 28 has an end fastened to the body 201 and is wound around the first reel 24. The spiral springs 26 provide a first recovering force F1 when the first reel 24 turns. The first recovering force F1 moves the sliding base 20 toward the first position P1 through the first string 28.

The arm 30 has a first rod 32 and a second rod 34. The first rod 32 has an end connected to the fixed base 17, and the second rod 34 engages the first rod 32 and is movable relative to the first rod 32. In an embodiment, the first rod 32 has a plurality of protrusions 322 on an inner side thereof, and the second rod 34 has a bore 342. The bore 342 of the second rod 34 is able to engage any one of the protrusions 322 of the first rod 32 to adjust the distance that the connecting device 36 can move. The second rod 34 further has an elongated slot 344 and an end portion 348 on a distal end thereof. The elongated slot 344 is open at a top side 346*a* and a bottom side 346*b* of the second rod 34. The end portion 348 has a first stop face 348*a* and a second stop face 348*b* at opposite sides.

Figure 5:
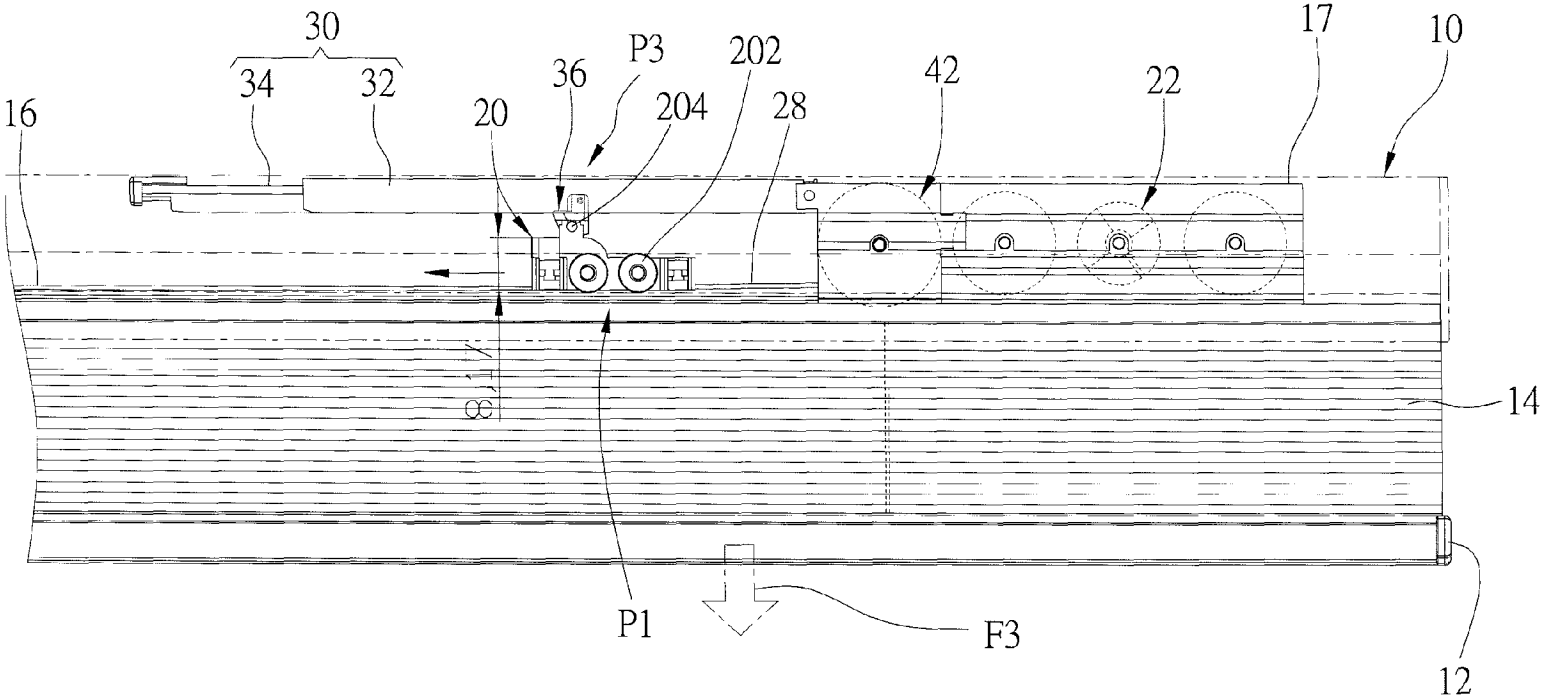
FIG. 5 is a front view of the first preferred embodiment of the present invention, showing the covering member being lowered and the sliding base being moved to the second position.
Figure 6:
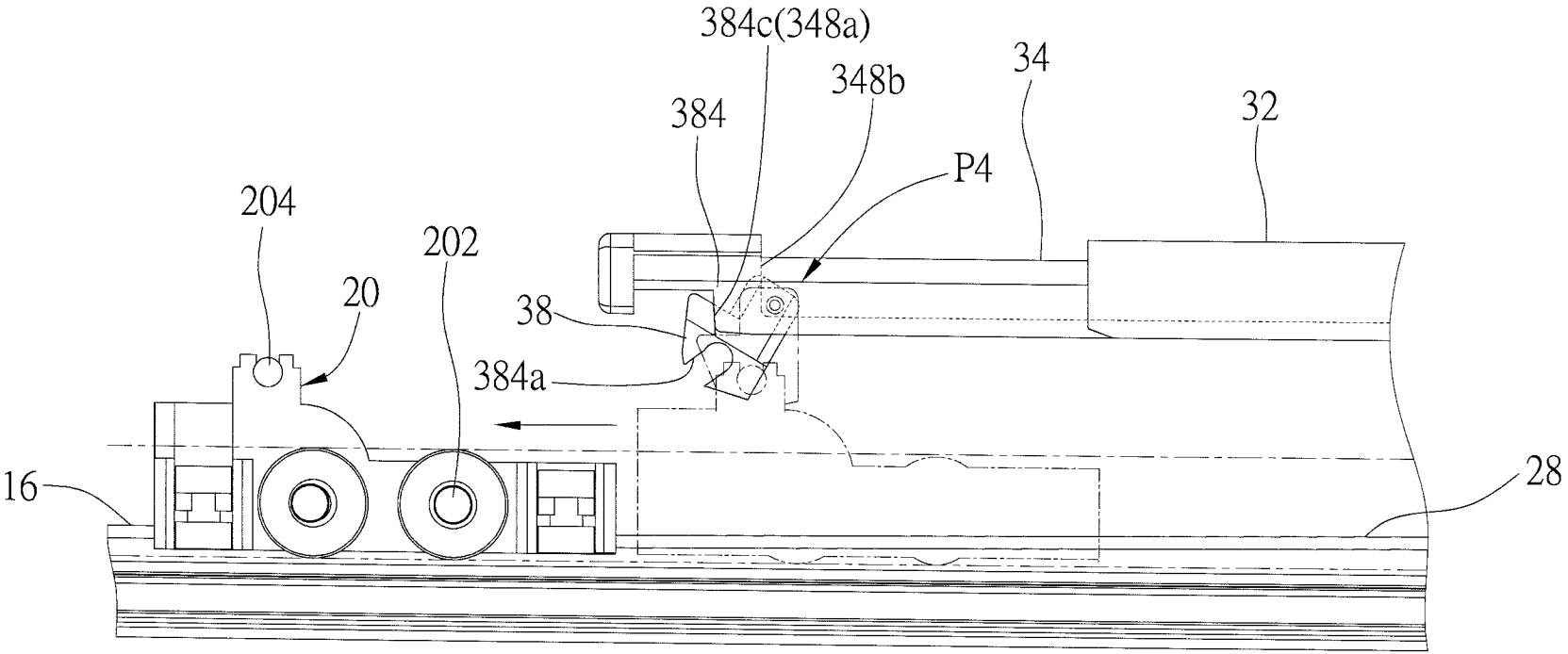
FIG. 6 is a front view of the first preferred embodiment of the present invention, showing the disengagement of the sliding base and the connecting device.

The connecting device 36 has a buckle 38 and a shaft 40. The buckle 38 has a body 382 and a head 384. The body 382 is received in the elongated slot 344 of the second rod 34. The shaft 40 is transversely mounted on the body 382, and is rested on the top side 346*a* of the second rod 34. The head 384 is under the bottom side 346*b* of the second rod 34. The connecting device 36 is movable in the elongated slot 344 between a third position P3 (FIG. 5) and a fourth position P4 (FIG. 6). In the first embodiment, the third position P3 is closer to the first position P1 than the fourth position P4, and the fourth position P4 is between the first position P1 and the second position P2. The head 384 has a connecting portion, which is a recess 384*a* in the first embodiment, and a stop face 384*c*. The recess 384*a* is tilted to engage and disengage the fixed rod 204 of the sliding base 20.

The second biasing device 42 has a second reel 44, a second biasing member, which is a spiral spring 46 in the first embodiment, and a second string 48. The second reel 44 is received in the fixed base 17 of the headrail 10 as well, and is between the first biasing device 22 and the arm 30. The spiral spring 46 is received in the second reel 44. The second string 48 has an end fastened to the shaft 40 of the connecting device 36 and is wound around the second reel 44. The spiral spring 46 provides a second recovering force F2 to wind the second string 48 around the second reel 44 and so as to move the connecting device 36 toward the third position P3.

As shown in FIG. 1, in the headrail 10, the strings 16 have ends fastened to the body 201 of the sliding base 20, and are wound around the pulley device 18 and the sliding base 20. As shown in FIG. 5, while a user exerts a force F3 on the bottom rail 12 to lower the covering member 14, it will move the sliding base 20 toward the second position P2 from the first position P1, and at the same time move the connecting device 36 in the same direction. As shown in FIG. 6, the connecting device 36 is stopped when the shaft 40 of the connecting device 36 touches the second stop face 348*b* of the end portion 348 of the arm 30 to hold the connecting device 36 at the fourth position P4. At the same time, the buckle 38 swings to disengage the fixed rod 204 of the sliding base 20 with the recess 384*a* of the buckle 38. As a result, the sliding base 20 keeps moving until it arrives at the second position P2. While sliding base 20 stops at the second position P2, the first recovering force F1 of the spiral springs 26 is identical to the weight of the bottom rail 12 and the covering member 14 to hold the covering member 14 rights there.

Figure 8:
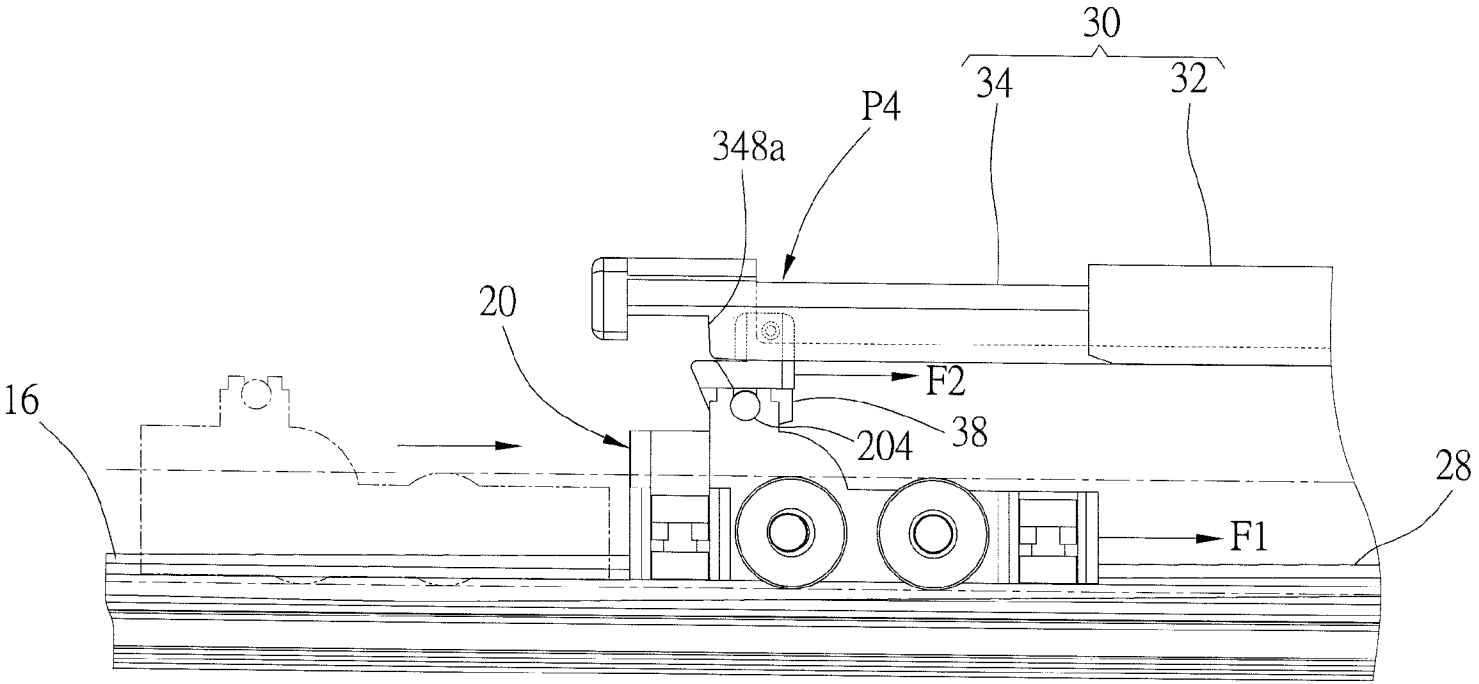
FIG. 8 is a front view of the first preferred embodiment of the present invention, showing the engagement of the sliding base and the connecting device.

As shown in FIG. 7, when the user exerts a force F4 on the bottom rail 12 to raise the covering member 14, the first recovering force F1 moves the sliding base 20 toward the first position P1 from the second position P2. As shown in FIG. 8, while the sliding base 20 is moved to the fourth position P4, the fixed rod 204 engages the recess 384*a* of the connecting device 36 and moves the buckle 38 to separate the stop face 384*c* from the first stop face 348*a* of the end portion 348 of the arm 30. At this time, the second recovering force F2 of the second biasing device 42 is added to wind the covering member 14. It may ensure that the covering member 14 is totally received in the headrail 10 when the sliding base 20 is moved to the first position P1. This is the main feature of the present invention to fix the problem of the conventional device in which the covering member can't be totally received in the headrail 10 after a long time of use. Another feature of the present invention is that the second rod 34 is movable relative to the first rod 32 so as to change the timing and place where the second recovering force F2 can start to help winding covering member 14. While the second rod 34 is adjusted to shorten the distance between the end portion 348 of the second rod 34 and the pulley device 18, the second recovering force F2 is added to wind the covering member 14 earlier. On the contrary, while the second rod 34 is adjusted to increase the distance between the end portion 348 of the second rod 34 and the pulley device 18, the second recovering force F2 is added to wind the covering member 14 later.

Figure 9:
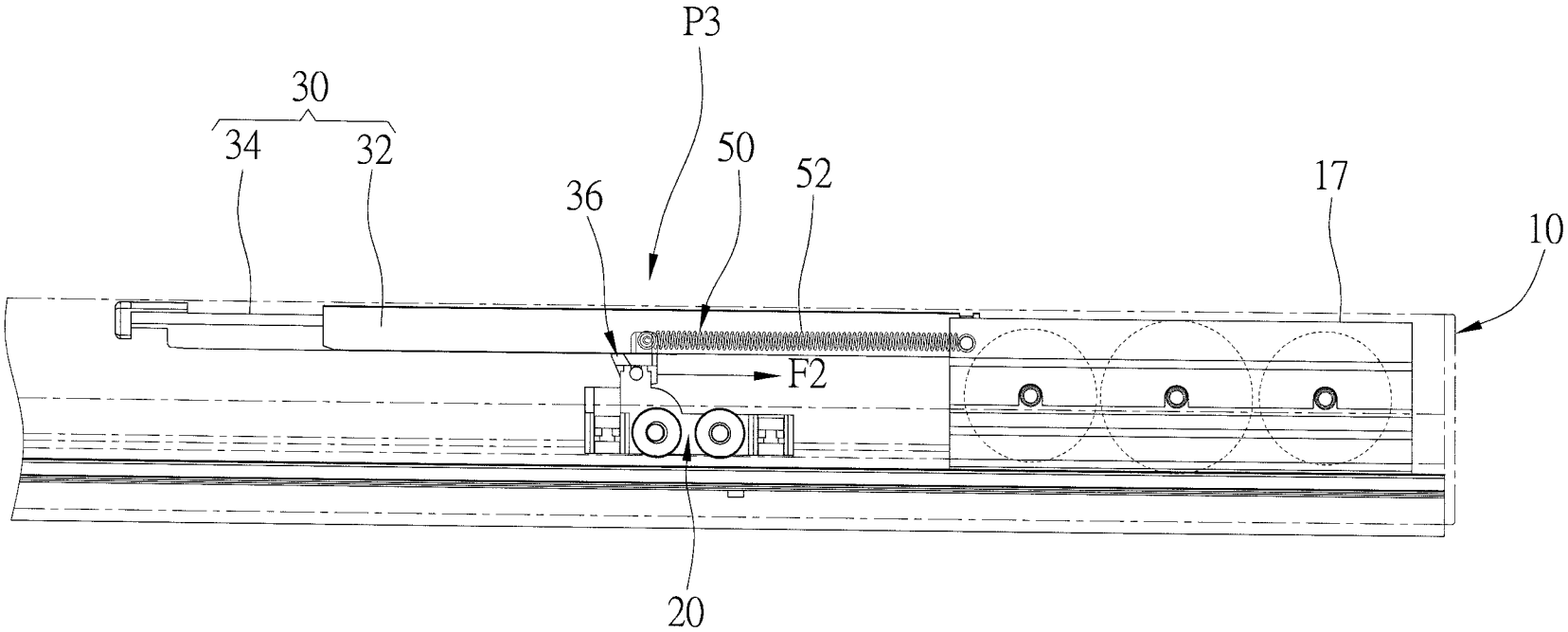
FIG. 9 is a sketch diagram of a second preferred embodiment of the present invention, showing the connecting device at the third position.
Figure 10:
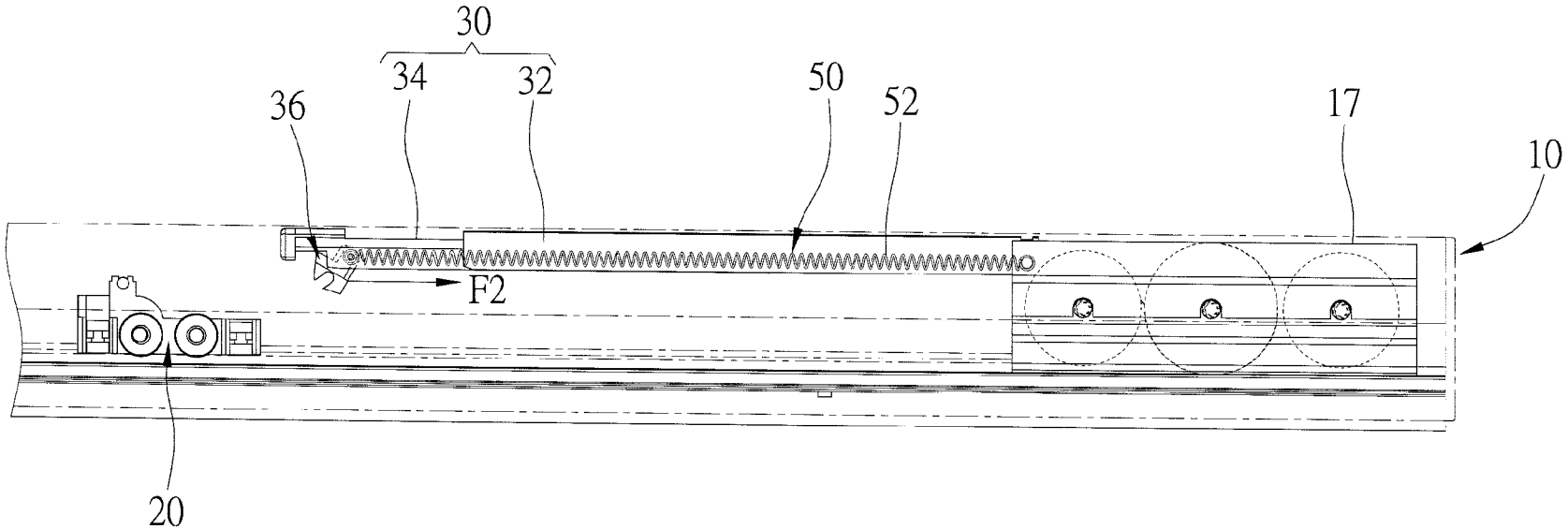
FIG. 10 is a sketch diagram of the second preferred embodiment of the present invention, showing the disengagement of the sliding base and the connecting device.

FIG. 9 and FIG. 10 show an apparatus for raising and lowering a covering member of a window covering of the second preferred embodiment, which is similar to the first preferred embodiment, except that an extension spring 52 is provided in a second biasing device 50 to replace the spiral spring 46 of the first preferred embodiment. In addition, the second biasing device 50 has no reel and string. The spring 52 has opposite ends connected to the fixed base 17 and the connecting device 36. FIG. 10 shows that the spring 52 is extended to generate the second recovering force F2 and so as to urge the connecting device 36 toward the third position P3 (FIG. 9). The spring 52 serves the same function as the spiral spring 46 in the first preferred embodiment.

The description above is only a few preferred embodiments of the present invention and the equivalence of the present invention is still in the scope of claim construction of the present invention.

What is claimed is:

1. An apparatus for raising and lowering a covering member of a window covering, wherein the apparatus is received close to or in a headrail of the window covering, the apparatus comprising:

a sliding base having a coupling portion, wherein the sliding base is moved between a first position and a second position in the headrail;

a first biasing device having a first string, a first reel, and at least one first biasing member, wherein the first string has an end fastened to the sliding base and is wound around the first reel; the first biasing member is deformed by the first reel to provide a first recovering force, and the first recovering force moves the sliding base toward the first position;

a connecting device having a connecting portion in association with the coupling portion of the sliding base, wherein the connecting device is moved between a third position and a fourth position in the headrail; the third position is closer to the first position than the fourth position, and the fourth position is between the first position and the second position; and a second biasing device having a second biasing member, wherein the second biasing member provides a second recovering force to move the connecting device toward the third position;

wherein the connecting portion of the connecting device disengages the coupling portion of the sliding base when the sliding base is moved toward the second position from the first position and arrives at the fourth position, and the connecting portion of the connecting device engages the coupling portion of the sliding base when the sliding base is moved toward the first position from the second position and arrives at the fourth position.

2. The apparatus as defined in claim 1, wherein the second biasing member is a spring with opposite ends connected to the connecting device and the headrail to provide the second recovering force.

3. The apparatus as defined in claim 1, further comprising an arm in the headrail, wherein the arm has an end portion, and the end portion has a first stop face; the connecting device is moved along the arm between the third position and the fourth position; the connecting device has a stop face to touch the first stop face of the arm when the connecting device is moved to the fourth position.

4. The apparatus as defined in claim 3, wherein the arm has an elongated slot, which is open at a top side and a bottom side of the arm; the connecting device has a buckle and a shaft fixed to the buckle; the buckle engages the elongated slot; the shaft is connected to the second biasing device and is rested on the top side of the arm, so that the buckle is moved in the elongated slot between the third position and the fourth position.

5. The apparatus as defined in claim 4, wherein the coupling portion of the sliding base is a fixed rod; the buckle has a body and a head; the body is received in the elongated slot; the shaft is transversely mounted on the body and is rested on the top side of the arm; the head is under the bottom side of the arm; and the connecting portion is a recess on the head to engage the fixed rod.

6. The apparatus as defined in claim 5, wherein the end portion further has a second stop face; the shaft touches the second stop face when the connecting device is moved to the fourth position; and at the same time, the buckle swings to have the stop face touching the first stop face when the sliding base moves toward the second position from the first position.

7. The apparatus as defined in claim 3, wherein the arm has a first rod and a second rod; the second rod has the end portion; and the second rod movably engages the first rod to change a location of the end portion.

8. The apparatus as defined in claim 7, wherein the first rod has a plurality of protrusions; and the second rod has a bore to engage any one of the protrusions of the first rod.

9. The apparatus as defined in claim 8, wherein the second biasing device has a second string and a second reel; the second string has an end fastened to the connecting device and is wound around the second reel; the second biasing member turns the second reel to wind the second string and so as to move the connecting device toward the third position.

* * * * *